United States Patent [19]

Sedlack

[11] Patent Number: 4,844,209

[45] Date of Patent: Jul. 4, 1989

[54] WALKER SAFETY BRAKE WITH SINGLE TOUCH ACTUATION

[75] Inventor: Mark A. Sedlack, Cuyahoga Falls, Ohio

[73] Assignee: Century Products Company, Macedonia, Ohio

[21] Appl. No.: 307,155

[22] Filed: Feb. 3, 1989

Related U.S. Application Data

[63] Continuation of Ser. No. 096,708, Sep. 14, 1987, abandoned.

[51] Int. Cl.[4] ..... B62B 9/12

[52] U.S. Cl. ..... 188/5; 188/167; 280/302; 280/87.051

[58] Field of Search ..... 16/32, 34; 188/5, 166, 188/167; 280/301, 302, 87.051; 292/38, 107, 209

[56] References Cited

U.S. PATENT DOCUMENTS

| | | | |
|---|---|---|---|
| 164,782 | 6/1875 | Tenney et al. . | |
| 1,106,240 | 8/1914 | Pierce | 280/302 |
| 1,332,826 | 3/1920 | Greischar | 280/302 |
| 3,090,634 | 5/1963 | Hesketh et al. | 280/31 |
| 3,217,839 | 11/1965 | Watkins et al. | 188/4 R |
| 3,981,372 | 9/1976 | Moreau | 280/302 X |
| 4,019,756 | 4/1977 | Ishida | 280/649 |
| 4,503,943 | 3/1985 | Tsukui | 16/34 X |
| 4,579,359 | 4/1986 | Schwartz | 280/87.02 |
| 4,436,303 | 3/1984 | McKillip et al. | 272/132 |

FOREIGN PATENT DOCUMENTS

| | | | |
|---|---|---|---|
| 465886 | 4/1914 | France | 280/302 |

*Primary Examiner*—Charles A. Marmor
*Assistant Examiner*—Michael Mar
*Attorney, Agent, or Firm*—Townsend and Townsend

[57] ABSTRACT

A safety brake for a child's walker is constructed of a braking bar pivotally mounted to the base of the walker for rotation between a nonbraking position above the wheels and a braking position whereby a straight section of the bar extends below the wheels to lift the wheels out of contact with the floor. A releasable catch on the walker base retains the braking bar in the nonbraking position, and a spring urges the bar into the braking position upon release thereof from the catch.

3 Claims, 2 Drawing Sheets

WALKER SAFETY BRAKE WITH SINGLE TOUCH ACTUATION

This is a continuation of application Ser. No. 096,708, filed Sept. 14, 1987, now abandoned.

BACKGROUND AND SUMMARY OF THE INVENTION

This invention relates to rolling seats, tables and other structures, with particular utility for baby walkers. This invention specifically addresses safety brakes on such structures.

Safety brakes have been incorporated into the construction of baby walkers to permit an adult to secure such a walker in a stationary position when desired. This is useful when a child must be left unattended, even momentarily, preventing accidents which might otherwise occur.

A braking mechanism in current use is shown in Schwartz, U.S. Pat. No. 4,579,359, Apr. 1, 1986 (Dorel Co. Ltd.). This mechanism consists of a pair of U-shaped bars pivotally mounted to the base of the walker. When braking is desired, these bars are swung down below the wheels to lie flat on the floor on which the walker rests, lifting the walker frame so that the wheels are no longer in contact with the floor. When not in use, the bars are swung up through the center of the base, permitting the wheels to be returned to rolling contact with the floor. In order to reach its stable flat position on the floor, the bar must swing through an arc which requires lifting the walker by hand to provide sufficient clearance. As the drawings in the Schwartz patent indicate, a considerable amount of clearance is required, so much so that both the walker and the baby occupying it must be disturbed substantially in order to move the bar into its braking position. This is particularly inconvenient for the adult, since it requires two hands as well as reaching either far under the walker or into the center of the base frame.

Latching mechanisms have also been provided to engage such bars when in the nonbraking position. These consist of protruding knobs on either side of the base frame. The somewhat resilient U-shaped bars are forced under these knobs, and are releasable by manual pressure outward on the bars themselves. Since the knobs are needed to hold the bars up while the walker is mobile, their release requires a further motion by the operator when the operator desires to move the bars into their braking position. The operator must first force the bar around both knobs (requiring both hands), then lift the walker frame several inches off the ground, and reach through or underneath the frame to swing the braking bar into position. Aside from being a complicated movement, this seriously disrupts the equilibrium of the baby occupying the walker (and any objects placed on the walker), and is impossible for the adult who has only one hand free.

A simplified and much improved braking construction has now been developed. According to the invention, the braking bar on which the vehicle frame rests when braked is a straight bar, pivotally mounted to the vehicle for rotation through an arc. The braking position is slightly beyond the lowest point of the arc, preferably about 10°–15° past it. Without a U-shaped bar, no extra clearance is required for swinging the braking bar into position. The structure further includes a spring urging the bar into its braking position, and a releasable catch to engage the bar when lifted upward and out of the way to restore mobility to the walker.

In preferred embodiments, the catch is an attachment to the base of the walker, made of resilient material which can be manually pressed to release the braking bar, whereupon the spring forces the bar to pivot into the braking position. The brake is thus engaged by a simple one-hand motion.

DETAILED DESCRIPTION OF THE INVENTION AND PREFERRED EMBODIMENTS

Figure 1:
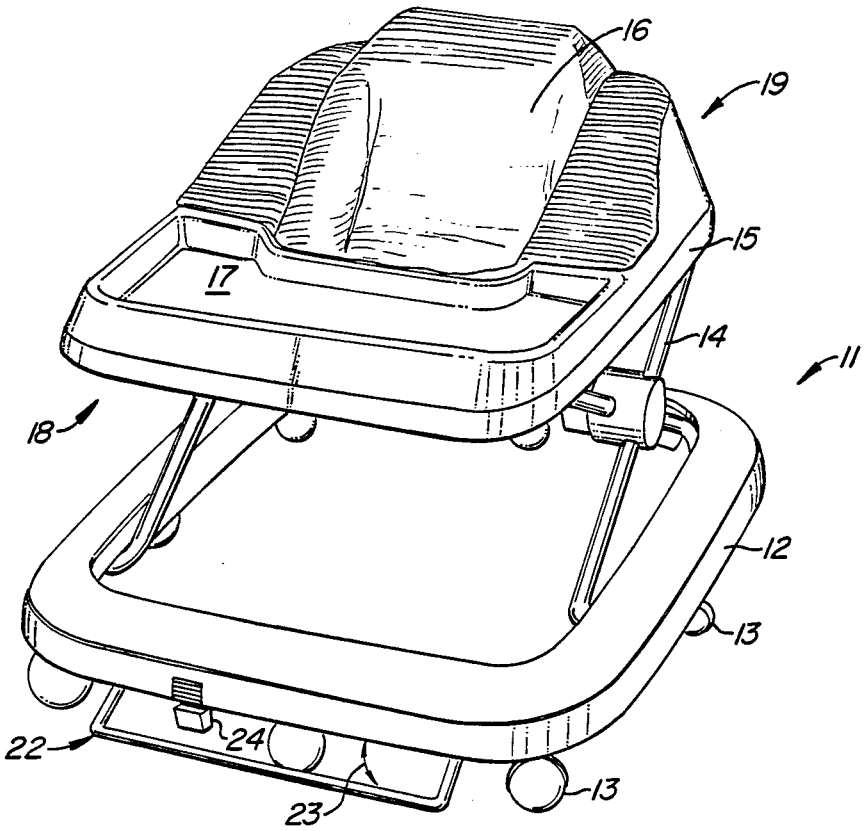
FIG. 1 is a perspective view of a baby walker with a safety brake in accordance with the present invention.

FIG. 1 shows a walker 11 constructed with a base ring 12 resting above a set of wheels 13 and supporting a height-adjustable scissors frame 14 on top of which is secured a table platform 15 which contains a seat 16 and a tray section 17 in front. The wheels 13 are spherical in shape, permitting them to pivot around a vertical axle as well as roll. The walker may thus move in any direction, and is generally propelled by the feet of the child extending through the seat 16 down through the middle of the base ring 12 to the floor underneath. The walker has a front end 18 and a rear end 19, as defined by the normal position of the baby placed inside--i.e., the baby faces the front end 18, and the tray section 17 is also at the front end.

Also included at the front end 18 of the walker is a braking bar 22, which is pivotally attached to the underside of the base ring 12 along the front end. The bar rotates up and down as indicated by the arrow 23, between braking and nonbraking positions, and may be secured in the nonbraking position by a catch 24.

Figure 2:
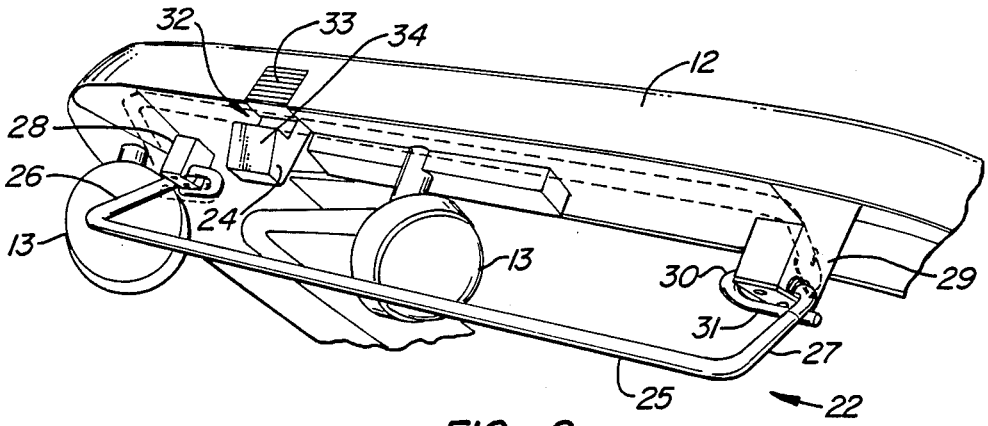
FIG. 2 is a view of the front end of the base of the walker of FIG. 1 as seen from below, showing the safety brake in both braking and nonbraking positions.

The mounting of the braking bar to the base ring is shown in FIG. 2. The bar has a central straight section 25 and a pair of side arms 26, 27 extending transversely with respect to the straight section 25 back to a pair of support blocks 28, 29 extending downward from the base ring. The ends of the side arms 26, 27 are bent in a U-shape opening laterally, with one leg 30 (hereinafter the "fulcrum leg") of each U pasing through each support block in a fit sufficiently loose to permit rotation of the bar, and the other leg 31 (hereinafter the "free leg") outside the support block, as a convenient means of limiting the arc of rotation of the braking bar.

The braking bar 22 is shown in solid lines in its braking position, and in dashed lines in its nonbraking position, held in the latter by the catch 24. The latter is preferably made of resilient material such as rubber or a polymeric material, which permits deformation under the application of an external force, with restoration to its original shape upon removal of the force. Thus, the catch may be bent backwards (i.e., toward the central opening of the base ring 12) by manual pressure, thereby releasing the braking bar 22.

In the embodiment shown, the catch itself is comprised of a groove 32 on its forward side, dividing the forward side into an upper section 33 and a lower section 34. The catch will be mounted with sufficient clearance at its rear (not shown) to permit one to bend it back under pressure to a sufficient degree to release the bar. For ease of operation, release of the catch may be achieved by finger pressure on the upper section 33. It will also be noted that the lower section 34 is angled inward in the downward direction such that forcing the straight section 25 of the braking bar upward over this section forces the catch backward to permit entry of the bar into the groove 30.

Figure 3:
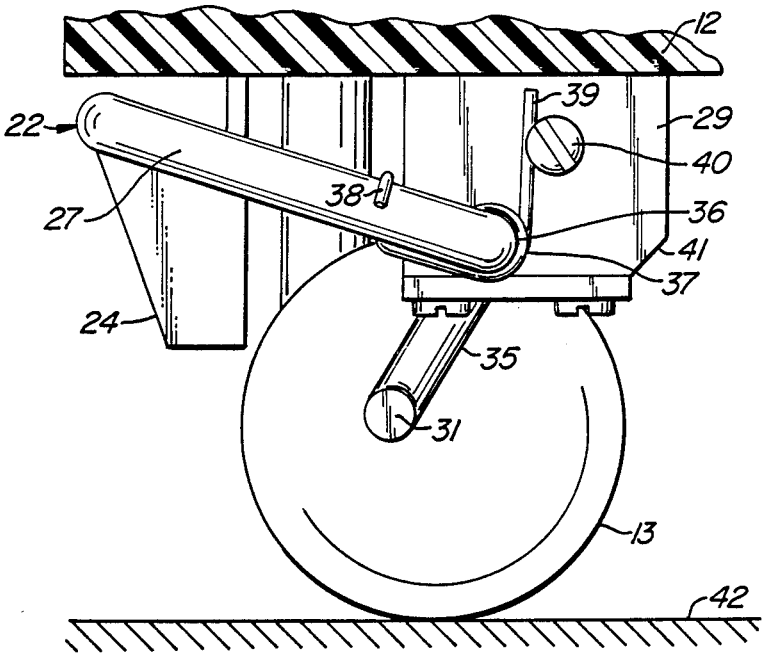
FIG. 3 is a side view of the safety brake of the embodiment shown in FIGS. 1 and 2, showing the braking bar in the nonbraking position, engaged by the catch.

FIG. 3 presents a side view of the right support block 29, viewed from the side toward the center of the base ring 12. The braking bar 22 is shown in the locked position up and out of the way of the wheels 13, permitting free mobility of the walker. This corresponds to the dashed line position of the braking bar shown in FIG. 2. The pivoting portion of the U-shaped end 35 of the braking bar passes through a channel 36 in the support block in a fit sufficiently loose to permit the rotation of the braking bar. A spring 37 is coiled around the fulcrum leg 30 of the U-shaped end. In the embodiment shown, the spring spirals in the clockwise direction outward from the plane of the figure. The spring is under tension urging it to uncoil, the tension increasing as the braking bar 22 is lifted up toward the nonbraking position shown in FIG. 3. The outer end 38 of the spring is looped around the side arm 27 of the braking bar, and the inner end 39 of the spring is secured against rotation by a screw 40 extending outward from the support block 29. The spring 37 is under maximum tension in the position shown in FIG. 3.

Figure 4:
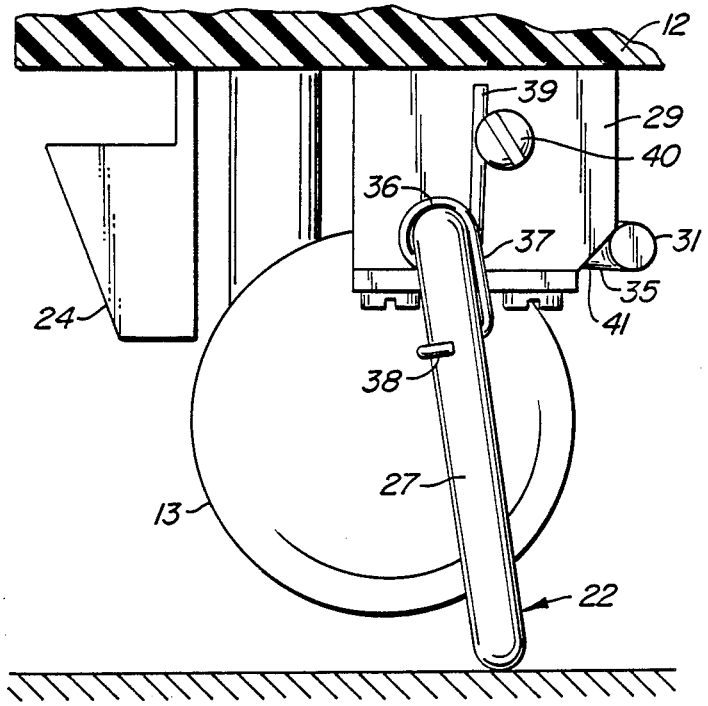
FIG. 4 is a view from the same angle as FIG. 3, showing the braking bar in the braking position.

FIG. 4 illustrates the braking bar 22 rotated to the braking position. The spring 37, although still under tension, is in a relatively relaxed position here compared with that of FIG. 3. The free leg 31 of the U-shaped end of the braking bar is forced against a surface 41 on the support block 29 by the spring 37, the surface thereby setting a limit on the rotation of the braking bar 22. In the embodiment shown, the braking position places the braking bar 22 at a position about 10°–15° past the lowest point in its arc, and it is only the straight section of the braking bar (FIG. 2) which contacts the floor 42. In this position, the straight section of the braking bar is well below the lowermost point of the wheel 13, causing the wheel to lift clear of the floor.

In addition to the force exerted by the spring 37, the braking bar 22 is further urged into the braking position whenever the child occupying the walker attempts to push the walker forward. The friction of the braking bar 22 against the floor adds to the backward force against the braking bar.

A second braking bar may be secured to the rear of the base ring 12 of the walker to provide an even stronger braking effect, although this is not visible in the views shown in the drawings. It is preferred that such a rear braking bar be positioned to pivot in the opposite direction, to swing toward the rear when passing from the braking position to the nonbraking position. A catch similar to the front catch 24 will then be positioned for operation by pressure applied from the rear.

The foregoing description is offered primarily for purposes of illustration. It will be readily apparent to those skilled in the art that further structural and functional variations beyond those described herein may be made without deparing from the spirit and scope of the invention.

What is claimed is:

1. A latching safety brake for a walker-type vehicle having a base and supported by a plurality of wheels mounted beneath said base for rolling along a surface, said latching safety brake comprising:

a support member comprised of a straight bar with two side arms;

means for pivotally mounting said side arms to the underside of said base adjacent a front end thereof with said straight bar extending transversely across a substantial portion of the width of said vehicle, said support member being adapted for rotation between a retracted position, with said straight bar located forwardly of said plurality of wheels and above said surface to permit rolling engagement of said plurality of wheels with said surface, and an extended position, with said straight bar located rearwardly of and below the lowermost portion of at least one of said wheels, to lift at least one of said wheels out of engagement with said surface, thereby braking said vehicle, said straight bar remaining horizontal in both said retracted and extended positions;

a releasable catch mounted on the front end of said base and comprised of a lug of resilient, deformable material having a groove with a cross-section adapted to receive and retain said straight bar when said support member is in said retracted position, said support member being releasable by manual pressure to said lug; and a spring for urging said support member toward said extended position upon being released from said catch, whereby when said support member is released and advanced to said extended position with said straight bar engaging said surface and at least one of said wheels being out of engagement with said surface, forward motion of said vehicle will not disengage said safety brake.

2. A latching safety brake in accordance with claim 1 in which said lug contains a forward facing side divided by said groove into a lower portion and an upper portion, said lower portion being angled to cause deformation of said lug upon passage thereover of said straight bar to effect entry of said bar into said groove.

3. A latching safety brake in accordance with claim 2 in which said upper portion is manually depressible to effect release of said straight bar from said groove.

* * * * *